US005716247A

United States Patent [19]

Ogino

[11] Patent Number: 5,716,247

[45] Date of Patent: Feb. 10, 1998

[54] BEARING ARRANGEMENT FOR MARINE TRANSMISSION

[75] Inventor: Hiroshi Ogino, Hamamatsu, Japan

[73] Assignee: Sanshin Kogyo Kabushiki Kaisha, Hamamatsu, Japan

[21] Appl. No.: 671,275

[22] Filed: Jun. 27, 1996

Related U.S. Application Data

[63] Continuation of Ser. No. 455,556, May 31, 1995, abandoned.

[30] Foreign Application Priority Data

May 31, 1994 [JP] Japan ..... 6-118798

[51] Int. Cl.[6] ..... B63H 21/28

[52] U.S. Cl. ..... 440/75; 440/83

[58] Field of Search ..... 440/75, 79–83, 440/900; 416/128, 129 A, 129 R; 192/48.7, 114 R

[56] References Cited

U.S. PATENT DOCUMENTS

| | | | |
|---|---|---|---|
| 537,612 | 4/1895 | Leathers . | |
| 599,125 | 2/1898 | Fefel . | |
| 624,674 | 5/1899 | Painton . | |
| 938,911 | 11/1909 | Taylor . | |
| 1,807,254 | 5/1931 | Piano . | |
| 1,813,552 | 7/1931 | Stechauner . | |
| 1,853,694 | 4/1932 | Melcher . | |
| 2,058,361 | 10/1936 | Sherwood . | |
| 2,064,195 | 12/1936 | De Michelis . | |
| 2,347,906 | 5/1944 | Hatcher | 74/389 |
| 2,372,247 | 3/1945 | Billing . | |
| 2,672,115 | 3/1954 | Conover | 115/17 |
| 2,987,031 | 6/1961 | Odden | 115/37 |
| 2,989,022 | 6/1961 | Lundquist | 115/37 |
| 3,148,557 | 9/1964 | Shimanckas . | |
| 3,478,620 | 11/1969 | Shimanckas | 74/665 |
| 3,769,930 | 11/1973 | Pinkerton | 115/35 |
| 4,529,387 | 7/1985 | Brandt | 440/66 |
| 4,540,369 | 9/1985 | Caires | 440/81 |
| 4,570,776 | 2/1986 | Iwashita et al. . | |
| 4,619,584 | 10/1986 | Brandt | 416/129 |
| 4,642,059 | 2/1987 | Nohara | 440/75 |
| 4,689,027 | 8/1987 | Harada et al. . | |
| 4,741,670 | 5/1988 | Brandt | 416/129 |
| 4,767,269 | 8/1988 | Brandt | 416/124 |
| 4,790,782 | 12/1988 | McCormick | 440/61 |
| 4,792,314 | 12/1988 | McCormick | 440/81 |
| 4,793,773 | 12/1988 | Kinouchi et al. | 416/129 |
| 4,795,382 | 1/1989 | McCormick | 440/81 |
| 4,828,518 | 5/1989 | Kouda et al. | 440/50 |
| 4,832,570 | 5/1989 | Solia | 416/93 A |
| 4,832,636 | 5/1989 | McCormick | 440/80 |
| 4,840,136 | 6/1989 | Brandt | 440/78 |
| 4,887,982 | 12/1989 | Newman et al. | 440/81 |
| 4,887,983 | 12/1989 | Bankstahl et al. | 440/57 |
| 4,897,058 | 1/1990 | McCormick | 440/80 |
| 4,932,907 | 6/1990 | Newman et al. | 440/57 |
| 4,957,460 | 9/1990 | Harada et al. . | |
| 4,963,108 | 10/1990 | Koda et al. | 440/81 |

(List continued on next page.)

FOREIGN PATENT DOCUMENTS

| | | |
|---|---|---|
| 64-28093 | 1/1989 | Japan . |
| 1-105041 | 4/1989 | Japan . |
| 1-309890 | 12/1989 | Japan . |

*Primary Examiner*—Ed Swinehart

*Attorney, Agent, or Firm*—Knobbe, Martens, Olson & Bear LLP

[57] ABSTRACT

A transmission for a marine outboard drive includes a compact bearing arrangement to provide an increased flow area for exhaust discharge behind the transmission with a lower unit of the drive. The bearing arrangement also improves the stability of a supported propulsion shaft. The bearing arrangement includes a first bearing assembly which supports the propulsion shaft at a point corresponding with the axial location at which a driving clutch is coupled to the shaft. The clutch selectively engages a driven gear of the transmission to drive the propulsion shaft. A thrust flange on the propulsion shaft desirably is positioned between the first bearing assembly and a second bearing assembly which journals the driven gear.

19 Claims, 6 Drawing Sheets

U.S. PATENT DOCUMENTS

| | | | |
|---|---|---|---|
| 4,986,774 | 1/1991 | Wantz | 440/75 |
| 4,993,848 | 2/1991 | John et al. | 384/97 |
| 5,006,084 | 4/1991 | Handa . | |
| 5,009,621 | 4/1991 | Bankstahl et al. | 440/75 |
| 5,017,168 | 5/1991 | Ackley | 440/82 |
| 5,030,149 | 7/1991 | Fujita | 440/82 |
| 5,186,609 | 2/1993 | Inoue et al. | 416/129 |
| 5,230,644 | 7/1993 | Meisenburg et al. | 440/80 |
| 5,232,386 | 8/1993 | Gifford | 440/80 |
| 5,249,995 | 10/1993 | Meisenburg et al. | 440/81 |
| 5,342,228 | 8/1994 | Magee et al. | 440/76 |
| 5,344,349 | 9/1994 | Meisenburg et al. | 440/80 |
| 5,352,141 | 10/1994 | Shields et al. | 440/80 |
| 5,366,398 | 11/1994 | Meisenburg et al. | 440/81 |
| 5,449,306 | 9/1995 | Nakayasu et al. | 440/75 |

BEARING ARRANGEMENT FOR MARINE TRANSMISSION

This application is a continuation of U.S. patent application Ser. No. 08/455,556, filed May 31, 1995, now abandoned.

BACKGROUND OF THE INVENTION

1. Field of the Invention

The present invention relates in general to a marine propulsion system, and more particularly to a transmission for a propulsion system of an outboard drive.

2. Description of the Related Art

Many outboard drives of marine watercrafts employ a counter-rotating propeller system operated by a forward-neutral-reverse-type of transmission. Such propulsion systems are common in both outboard motors and in outboard drive units of inboard/outboard motors.

Prior transmissions used with the counter-rotating propeller systems typically lie within a lower unit of the drive and include a driving bevel gear and a pair of oppositely rotating driven bevel gears. Each driven gear includes a hub that is journaled within a lower unit of the outboard drive. A front dog clutch is interposed between the pair of oppositely rotating gears. In this position, the front dog clutch is moved between drive positions where it engages one of the gears. In this manner, the front dog clutch selectively couples an inner propeller shaft to one of the driven gears to rotate a rear propeller in either a forward or a reverse direction.

The transmission also includes a rear dog clutch that is positioned to the rear side of the rear driven gear hub. The rear clutch selectively engages corresponding teeth formed on the rear side of the hub of the rear gear to drive an outer propeller shaft. The outer propulsion shaft in turn drives a front propeller.

Prior transmission designs tend to occupy a significant amount of space in the lower unit on the rear side of the drive shaft. In this location, the lower unit also houses an exhaust passageway for the discharge of engine exhaust.

The large size of prior transmissions used with counter-rotational propulsion systems commonly leaves less space for the exhaust passage though the lower unit. Inadequate exhaust flow area can result in higher back pressure, and engine exhaust tends not to discharge smoothly. Engine performance consequently suffers. This problem becomes more acute with larger engines. It becomes necessary to increase the flow area of the exhaust passage through the lower unit in order to discharge exhaust gas smoothly.

Lower units thus have increased in size to accommodate the larger exhaust passages with current transmission designs. An increased size in the lower unit, however, undesirably increases the resistance to fluid flow around the lower unit, i.e., undesirably increases the drag on the lower unit.

The front end of the outer propulsion shaft commonly is left unsupported in prior transmission designs. The outer shaft consequently tends to vibrate within the transmission.

SUMMARY OF THE INVENTION

A need therefore exists for a compact transmission for a counter-rotation propulsion system which provides increased space for an adequately sized exhaust passage through a lower unit to discharge engine exhaust smoothly, as well as improve the stability of the outer shaft.

In accordance with one aspect of the present invention, a transmission for a marine outboard drive comprises a first driven gear and a corresponding first clutch. The first clutch is coupled to a first propulsion shaft and the first driven gear is supported by a first bearing assembly. The propulsion shaft extends through a bearing carrier along a drive axis with a second bearing assembly journaling a portion of the first propulsion shaft within the bearing carrier. The second bearing assembly is disposed within a recess within the bearing carrier in a position which generally corresponds to the position of the first clutch along the drive axis. The first propulsion shaft includes at least one thrust flange positioned between the first and second bearings assemblies.

Another aspect of the present invention involves a transmission for a marine outboard drive. The transmission comprises a first driven gear supported by a first bearing assembly, and a corresponding first clutch which is coupled to a first propulsion shaft of the outboard drive. The first clutch selectively couples the first propulsion shaft to the first driven gear. The propulsion shaft includes a hollow rim which surrounds at least a portion of the first clutch. The rim terminates at a front thrust flange on the shaft which is positioned proximate to the driven gear and arranged so as to load the first bearing assembly. A second bearing assembly supports the rim of the first propulsion shaft and is positioned directly behind the front thrust flange.

BRIEF DESCRIPTION OF THE DRAWINGS

These and other features of the invention will now be described with reference to the drawings of preferred embodiments of the present invention, which are intended to illustrate and not to limit the invention, and in which.

DETAILED DESCRIPTION OF PREFERRED EMBODIMENTS

Figure 1:
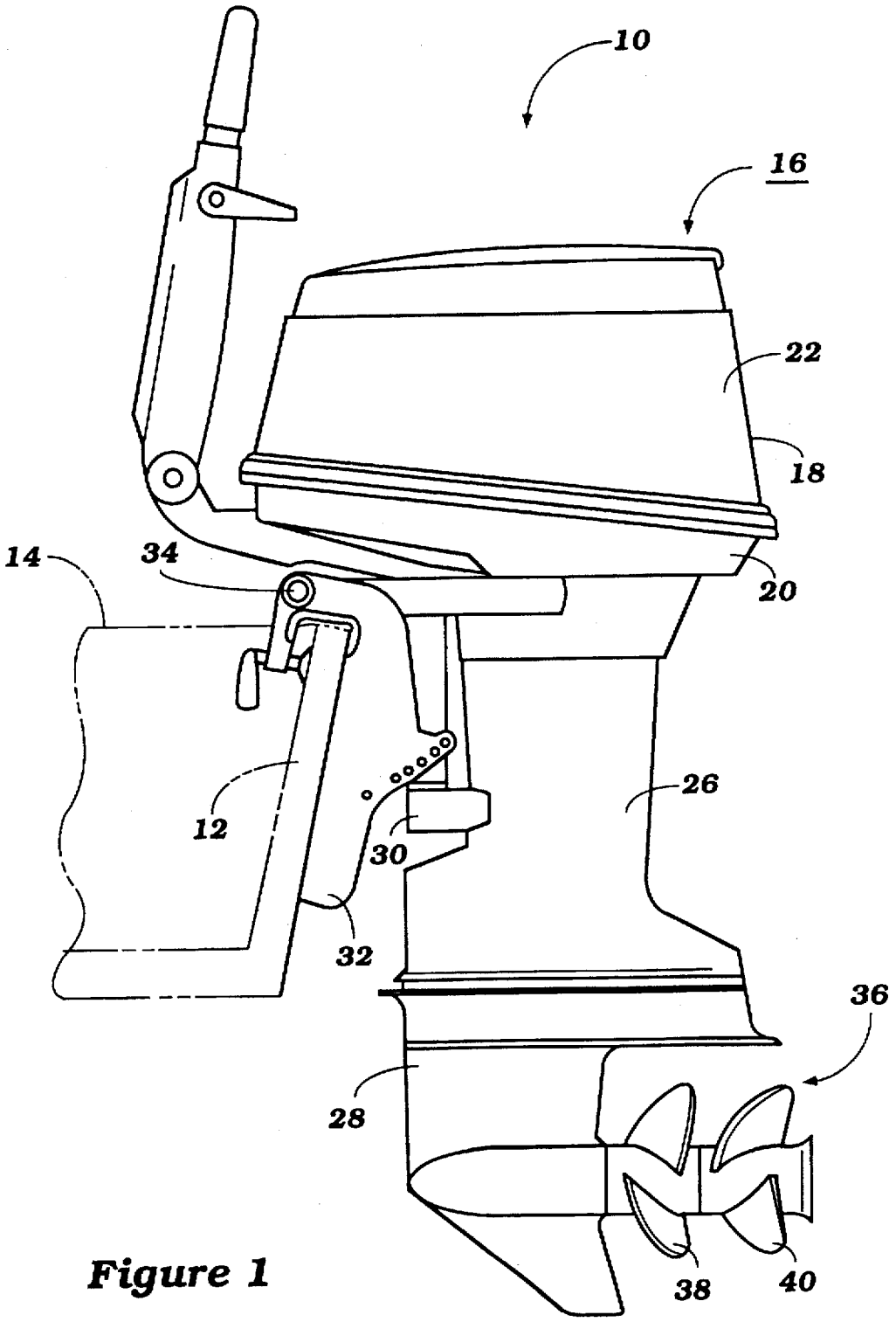
FIG. 1 is a side elevational view of an outboard drive which embodies a transmission in accordance with a preferred embodiment of the present invention.

FIG. 1 illustrates a marine outboard drive 10 configured in accordance with a preferred embodiment of the present invention. In the illustrated embodiment, the outboard drive 10 is depicted as an outboard motor for mounting on a transom 12 of a watercraft 14. It is contemplated, however, that those skilled in the art will readily appreciate that the present invention can be applied to stern drive units of inboard-outboard motors and to other types of watercraft drive units as well.

In the illustrated embodiment, the outboard drive 10 has a power head 16 which includes an engine. A conventional protective cowling 18 surrounds the engine. The cowling 18 desirably includes a lower tray 20 and a top cowling member 22. These components 20, 22 of the protective cowling 18 together define an engine compartment which houses the engine.

The engine is mounted conventionally with its output shaft (i.e., crankshaft) rotating about a generally vertical axis. The crankshaft (not shown) drives a drive shaft 24 (FIG. 2), as known in the art. The drive shaft 24 depends from the power head 16 of the outboard drive 10.

A drive shaft housing 26 extends downward from the lower tray 20 and terminates in a lower unit 28. The drive shaft 24 extends through and is journaled within the drive shaft housing 26, as known in the art.

A steering bracket 30 is attached to the drive shaft housing 26 in a known matter. The steering bracket 30 also is pivotably connected to a clamping bracket 32 by a pin 34. The clamping bracket 32, in turn, is configured to attach to the transom 12 of the watercraft 14. This conventional coupling permits the outboard drive 10 to be pivoted relative to the steering bracket 30 for steering purposes, as well as to be pivoted relative to the pin 34 to permit adjustment to the trim position of the outboard drive 10 and for tilt up of the outboard drive 10. Although not illustrated, it is understood that a conventional hydraulic tilt and trim cylinder assembly, as well as a conventional hydraulic steering cylinder assembly could be used as well with the present outboard drive 10.

The engine of outboard motor drives a propulsion device 36, such as, for example, a propeller, a hydrodynamic jet, or the like. In the illustrated embodiment of FIG. 1, the propulsion device 36 is a counter-rotating propeller device that includes a front propeller 38 designed to spin in one direction and to assert a forward thrust, and a rear propeller 40 designed to spin in the opposite direction and to assert a forward thrust.

Figure 2:
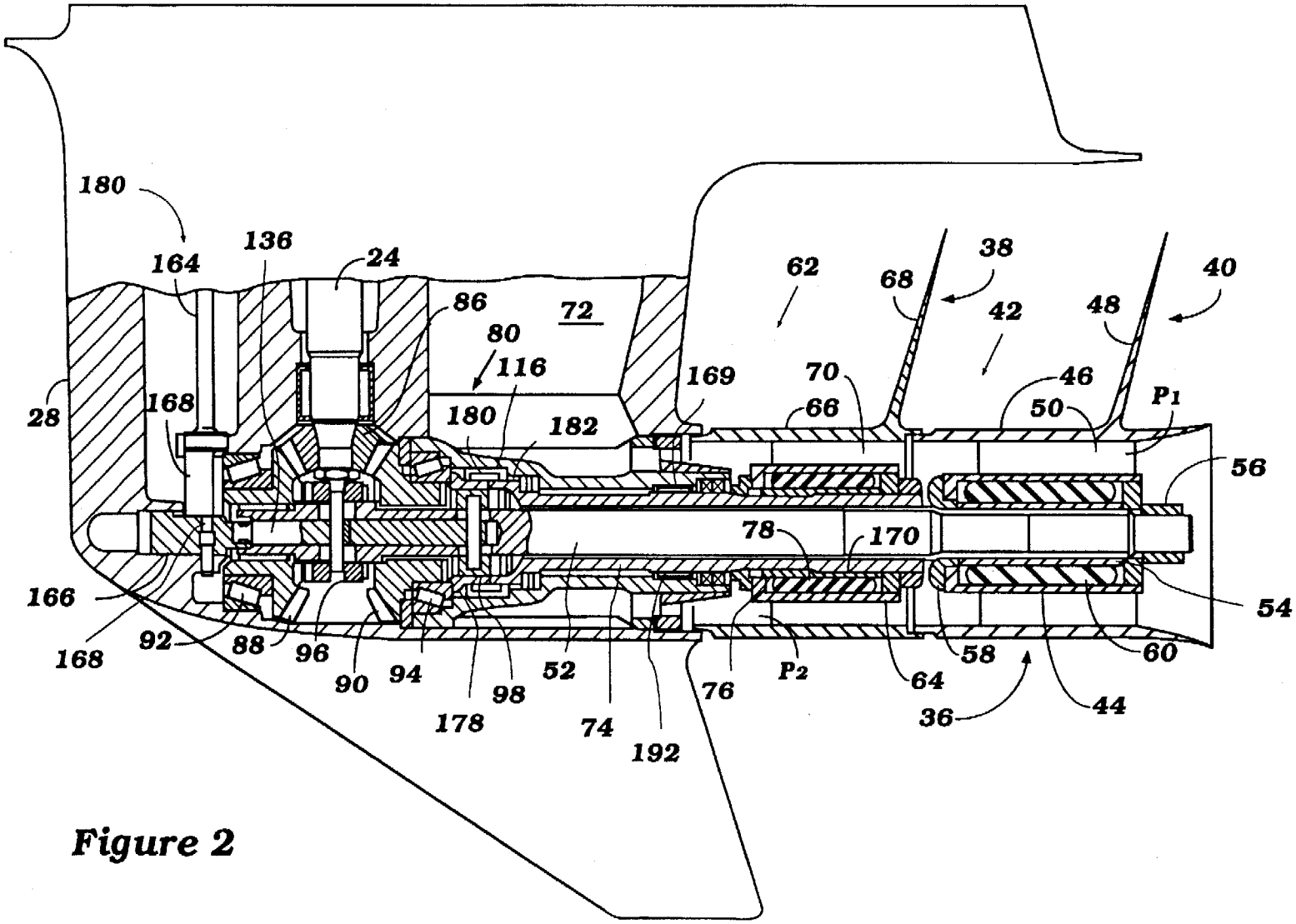
FIG. 2 is a sectional side elevational view of a lower unit of the outboard drive of FIG. 1 illustrating a preferred embodiment of the present transmission.

FIG. 2 illustrates the components of the front and rear propellers 38, 40. The rear propeller 40 includes a boss 42 which is formed in part by an inner sleeve 44 and an outer sleeve 46 to which the propeller blades 48 are integrally formed. A plurality of radial ribs 50 extend between the inner sleeve 44 and the outer sleeve 46 to support the outer sleeve 46 about the inner sleeve 44 and to form a passage $p_1$through the propeller boss 42. Engine exhaust is discharged through the passage $P_1$, as known in the art.

An inner propulsion shaft 52 drives the rear propeller boss 42. For this purpose, the rear end of the inner shaft 52 carries an engagement sleeve 54 having a spline connection with the rear end of the inner shaft 52. The sleeve 54 is fixed to the rear end of the inner shaft 52 between a nut 56 threaded on the rear end of the shaft 52 and an annular thrust washer 58 positioned between the front and rear propellers 38, 40. An elastic bushing 60 is interposed between the engagement sleeve 54 and the rear propeller boss 42 and is compressed therebetween. The bushing 60 is secured to the engagement sleeve 54 by a heat process known in the art. The frictional engagement between the boss 42, the elastic bushing 60, and the engagement sleeve 54 is sufficient to transmit rotational forces from the sleeve 54, driven by the inner propulsion shaft 52, to the rear propeller blades 48.

The front propeller 38 likewise includes a front propeller boss 62. The front propeller boss 62 has an inner sleeve 64 and an outer sleeve 66. propeller blades 68 of the front propeller 38 are integrally formed on the exterior of the outer sleeve 64. Ribs 70 interconnect the inner sleeve 66 and the outer sleeve 64 and form an axially extending passage $P_2$ between the sleeves 64, 66. The passage $P_2$ communicates with a conventional exhaust discharge passage 72 in the lower unit and with the exhaust passage of the rear propeller boss $P_1$.

An outer shaft 74 carries the front propeller 38. As best seen in FIG. 2, the rear end portion of the outer shaft 74 carries a front engagement sleeve 76 in driving engagement thereabout by a spline connection. The front engagement sleeve 76,is secured onto the outer shaft between the annular retaining ring 58 and the lower unit 28.

A front annular elastic bushing 78 surrounds the front engagement sleeve 76. The bushing 78 is secured to the sleeve 76 by heat process known in the art.

The front propeller boss 62 surrounds the elastic bushing 78, which is held under pressure between the boss 62 and the sleeve 76 in frictional engagement. The frictional engagement between the propeller boss 62 and the bushing 78 is sufficient to transmit a rotational force from the sleeve 76 to the propeller blades 68 of the front propeller boss 62.

As seen in FIG. 2, the drive shaft 24 and the inner and outer propulsion shafts 52, 74 extend coaxially to each other. A transmission 80 selectively interconnects the drive shaft 24 and the propulsion shafts 52, 74.

As seen in FIG. 2, the drive shaft 24 extends from the drive shaft housing 26 into the lower unit 28. At its lower end, the drive shaft 24 carries a drive gear or pinion 86 which forms a portion of the transmission 80. The drive gear 86 preferably is a bevel type gear.

The transmission 80 also includes a pair of counter-rotating driven gears 88, 90 that are in mesh engagement with the drive gear 86. The pair of driven gears 88, 90 preferably are positioned on diametrically opposite sides of the drive gear 86 and are suitably journaled within the lower unit 28 by front and rear bearing assemblies 92, 94, respectively, as described below.

FIG. 2 also illustrates a front clutch 96 and a rear clutch 98 of the present transmission 80. As discussed in detail below, the front clutch 96 selectively couples the inner propulsion shaft 52 to either to the front gear or to the rear gear. The rear clutch 98 selectively couples the outer propulsion shaft 74 to the rear gear 90. In the illustrated embodiment, the clutches 96, 98 are positive clutches, such as, for example, dog clutches; however, it is understood that the present transmission could be designed with friction-type clutches. The individual components of the present transmission 80 will now be described in detail.

Figure 3:
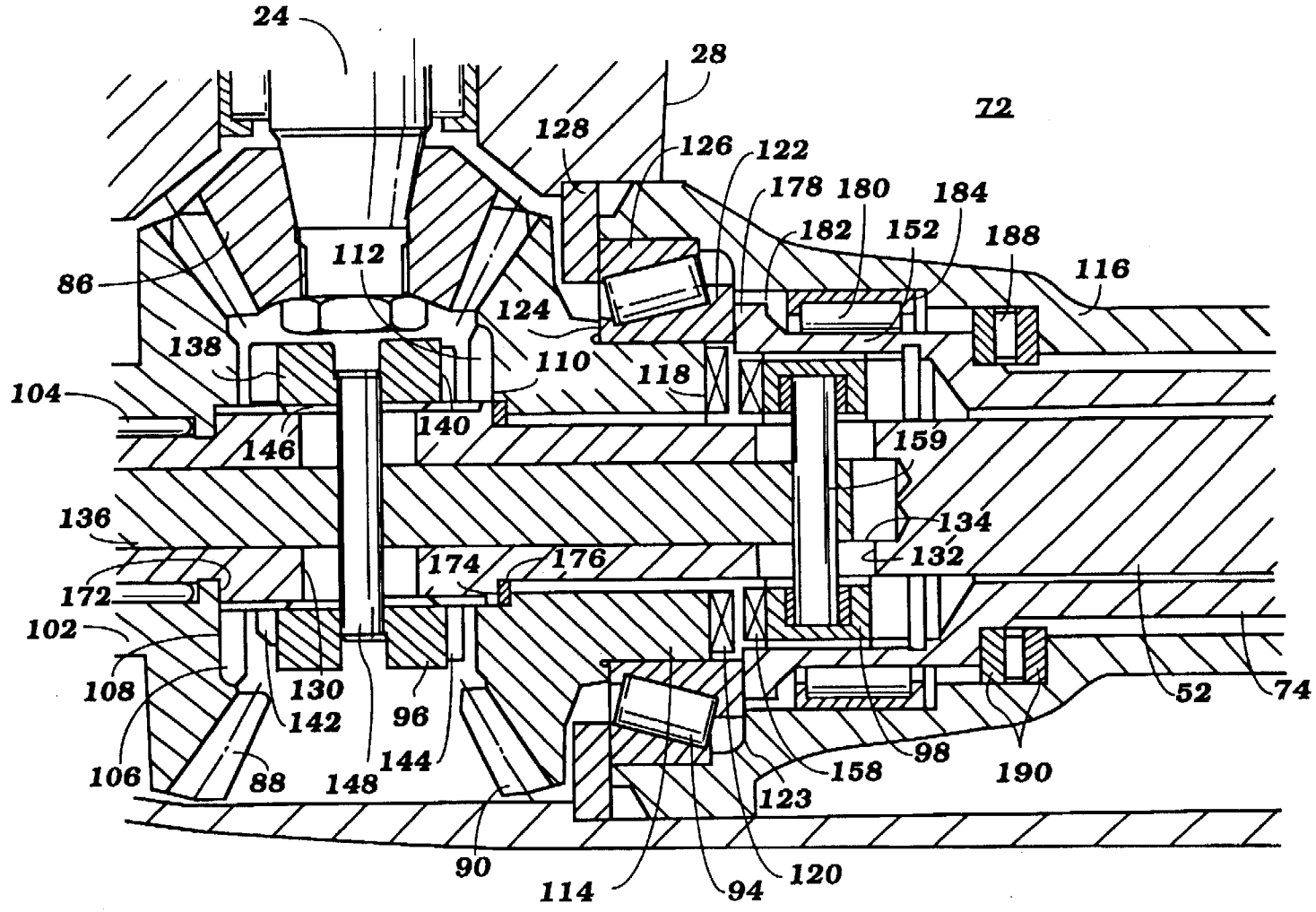
FIG. 3 is an enlarged, sectional side elevational view of the transmission of FIG. 2.

With reference to FIG. 3, each driven gear 88, 90 of the transmission 80 is positioned at about a 90° shaft angle with the drive gear 86. That is, the propulsion shafts 52, 74 and the drive shaft 24 desirably intersect at about a 90° shaft angle; however, it is contemplated that the drive shaft 24 and the propulsion shafts 52, 74 can intersect at almost any angle.

In the illustrated embodiment, the pair of driven gears are a front bevel gear 88 and an opposing rear bevel gear 90. The front gear 88 includes a bearing hub 102 which is journaled within the lower unit by the front thrust bearing 92. The front thrust bearing 92 rotatably supports the front gear 88 in mesh engagement with the drive gear 86.

The hub 102 has a central bore through which the inner propulsion shaft 52 passes when assembled. A plurality of needle bearings 104 journal the inner propulsion shaft 52 within the central bore of the front gear hub 102. As seen in FIG. 3, the inner propulsion shaft 52 includes a step diameter section to form a seat for the needle bearings 104 in this location.

The front gear 88 also includes a series of teeth 106 formed on an annular rear facing engagement surface 108. The teeth 106 positively engage the front clutch 96 of the transmission 80, as discussed below.

As seen in FIG. 3, the rear gear 90 also includes an annular front engagement surface 110 which carries a series of clutching teeth 112. The teeth 112 are configured to positively engage the front clutch 96 of the transmission 80, as discussed below.

The rear thrust bearing assembly 94 journals a hub 114 of the rear gear 90 within an enlarged front end of a bearing carrier 116 attached within the lower unit 28. The rear thrust bearing 94 rotatably supports the rear gear 90 in mesh engagement with the drive pinion 86.

The hub 114 of the rear gear 90 has a central bore through which the inner propulsion shaft 52 passes when assembled. The bore extends between the front engagement surface 110 and a rear engagement surface 118.

The rear engagement surface 118 includes a series of teeth 120. The teeth 120 are configured to positively engage the rear clutch 98 of the transmission 80, as discussed below.

As illustrated in FIG. 3, the thrust bearing assembly 94 includes an cone 122 on which a shoulder 124 of the rear gear 90 acts against. In this manner, the thrust bearing assembly 94 takes the loading on the rear gear 90. A portion of the cone 122 rests against a front facing shoulder 123 within the bearing carrier.

A cup 126 of the bearing assembly 94 is captured between a shoulder within a bearing carrier 116 and a shim ring 128 positioned in front of the bearing carrier 116. Forward and reverse thrust loadings on the rear thrust bearing assembly 94 are transferred to the lower unit 28 either through the bearing carrier 116 or through the shim ring 128, depending upon the direction of the resultant thrust loading, as described below.

As seen in FIG. 3, the driven gears 88, 90 are journaled about the inner shaft 52 at positions generally symmetric to the axis of the drive shaft 24. In this position, the gears 88, 90 lie to the sides of a front aperture 130 of the inner drive shaft 52. The front aperture 130 extends through the inner shaft 52, transverse to the axis of the inner shaft 52. The inner shaft 52 also includes a rear aperture 132 that extends transverse to the axis of the shaft 52, at a position behind rear driven gear 90.

The inner propulsion shaft 52 includes a longitudinal bore 134 which is sized to receive the clutch actuating plunger 136. The bore 134 stems from the front end of the inner shaft 52 to a bottom surface which is positioned beyond the axial position of the rear clutch 98.

The front clutch 96 is arranged in between the front and rear driven gears 88, 90 on the inner shaft 52. As seen in FIG. 3, the front clutch 96 generally has a spool-like shape and includes an axial bore which extends between an annular front end plate 138 and an annular rear end plate 140. The bore is sized to receive the inner propulsion shaft 52.

The annular end plates 138, 140 of the front clutch 96 are substantially coextensive in size with the annular engagement surfaces 108, 110 of the front and rear gears 88, 90, respectively. The annular end plates 138, 140 each support a plurality of clutching teeth 142, 144 which correspond in size and number with the teeth 106, 112 formed on the respective engagement surfaces 108, 110 of the front and rear gears 88, 90.

The front clutch 96 has a spline connection (generally referenced as reference numeral 146) to the inner propulsion shaft 52. Internal splines of the front clutch 96 mate and engage with external splines on the external surface of the inner drive shaft 52. This spline connection 146 provides a driving connection between the front clutch 96 and the inner propulsion shaft 52, while permitting the front clutch 96 to slide over the inner propulsion shaft 52, as discussed below.

As seen in FIG. 3, the front clutch 96 also includes a hole that extends through the midsection of the clutch 96 in a direction generally transverse to the longitudinal axis of the clutch 96. The hole is sized to receive a pin 148 which, when passed through the front aperture 130 of the inner propulsion shaft 52 and through a front hole 150 of the plunger 136, interconnects the plunger 136 and the front clutch 96 with a portion of the inner shaft 52 interposed therebetween. The pin 148 may be held in place by a press-fit connection between the pin 148 and the hole in the clutch body, or by a conventional coil spring (not shown) which is contained within a groove about the middle of the front clutch 96.

As best seen in FIG. 3, the rear clutch 98 has a cylindrical sleeve shape sized to fit within a hollow front rim 152 of the outer propulsion shaft 74. External splines extend from the cylindrical external surface of the rear clutch 98. The external splines mate with corresponding internal splines on inner surface of the outer shaft rim 152 to establish a driving connection between the rear clutch 98 and the outer shaft 74, yet permit the clutch 98 to slide along the axis of the shaft 74 within the hollow front rim 152.

The rear clutch 98 also includes an axial bore which extends between an annular front engagement plate 154 and a rear end 156. The bore is sized to receive the inner propulsion shaft 52.

The front annular end plate 154 of the rear clutch 98 is substantially coextensive in size with the rear annular engagement surface 118 of the rear gear 90. Teeth 158 extend from the front engagement plate 154 of the rear clutch 98 and desirably correspond to the teeth 120 of the rear gear 90 in size (e.g., axial length), in number, and in configuration.

The rear clutch 98 also includes an internal annular groove which is sized to receive a pin 159 that extends through the rear aperture 132 of the inner propulsion shaft 52 and through a hole in the plunger 136. Roller bearings journal the pin 159 within the internal groove of the rear clutch 98, as known in the art. In this manner, the rear clutch 98 is rotatably coupled to the plunger 136, while drivingly connected to the outer propulsion shaft 74.

The pin 159 is inserted into the internal annular groove of the clutch 98 through a transverse aperture in the clutch body. When assembled, the pin 159 passes through the aperture and is inserted between the bearings, through the rear aperture 132 of the inner propulsion shaft 52 and through the hole of the plunger 136. The pin may be held in place by a press-fit connection between the pin and the hole of the plunger 136, or by other conventional means.

Figure 4:
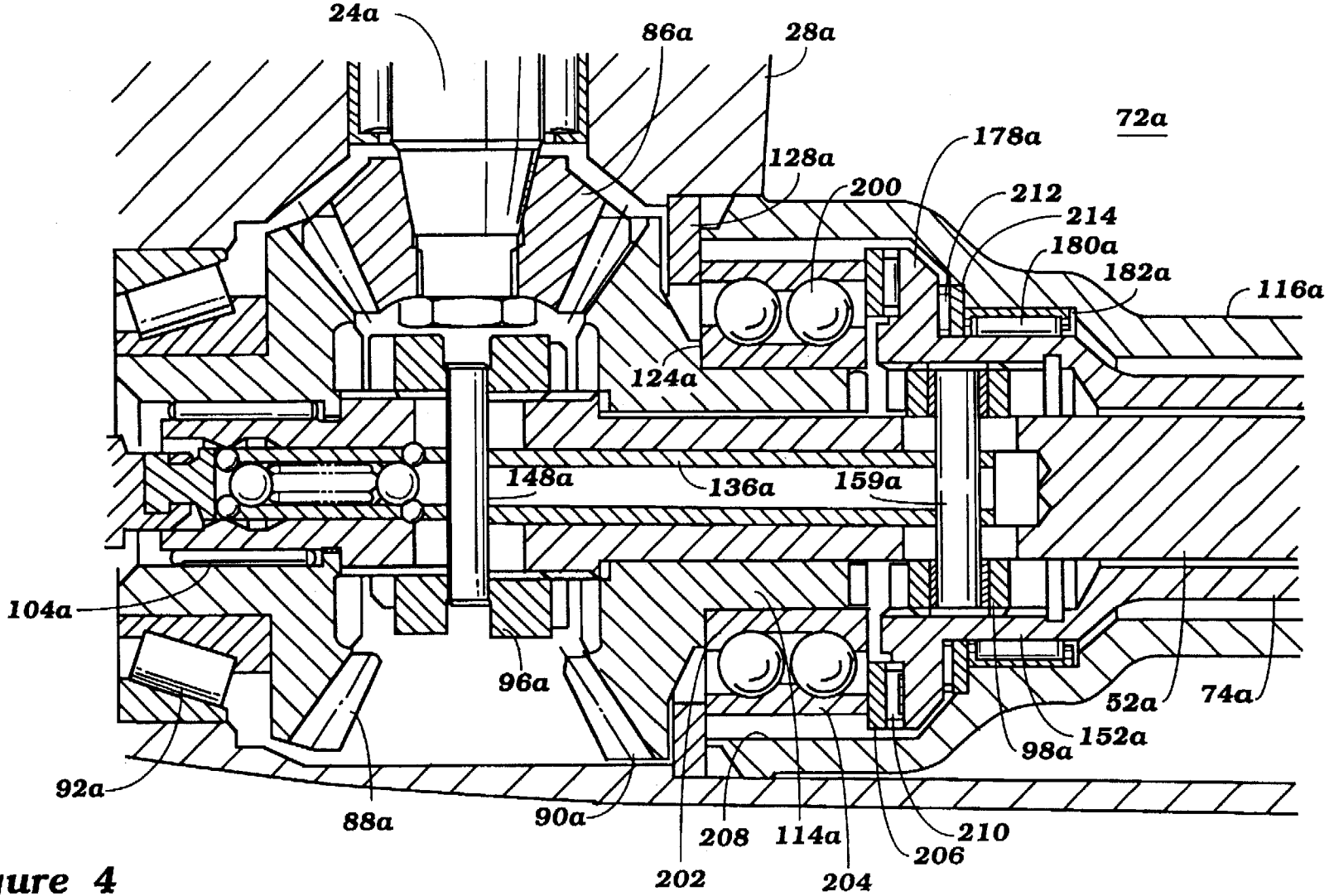
FIG. 4 is an enlarged, sectional side elevational view of a transmission in accordance with another embodiment of the present invention.

The plunger 136 interconnects the front and rear clutches 96, 98, as noted above. The plunger 136 has a generally cylindrical rod shape and slides within the longitudinal bore of the inner shaft 52 to actuate the clutches 96, 98. The plunger 136 may be solid (as seen in FIG. 3) or hollow (as seen in FIG. 4) in order to accommodate a conventional neutral detent mechanism.

With reference to FIG. 2, an actuator mechanism 160 moves the plunger 136 from a position in which the front and rear clutches 96, 98 engage the first and second gears 88, 90, respectively, through a position of non-engagement (i.e., the neutral position), and to a position in which the front clutch 96 engages the rear gear 90. The actuator mechanism 160 positively reciprocates the plunger 136 between these positions.

The actuator mechanism 160 includes a cam member 162 which couples the plunger 136 to a rotatable shift rod 164. In the illustrated embodiment, the shift rod 164 depends in the vertical direction through the drive shaft housing 26 and into the lower unit 28. The actuator mechanism 160 also includes a remote gear shifter, which is conventionally mounted proximate to the steering controls of the watercraft (not shown). The gear shifter includes a shift lever which is coupled to a conventional shift slider via a bowden wire cable. The shift slider connects to a lever arm, which in turn connects to one end of a link. An opposite end of the link is fixed to the shift rod 164 so as to move the cam member 162 of the actuator mechanism 160 in response to movement of the shift lever, as known in the art. In this manner, the actuator mechanism 160 controls the transmission 80.

As understood from FIG. 2, the forward end of the plunger 136 is captured within a slot formed in an actuating cam follower 166 which is slidably supported in a known manner in the front of the lower unit 28. The interconnection between the actuating cam follower 166 and the front end of the plunger 136 allows the plunger 136 to rotate with the inner shaft 52 relative to the actuating cam follower 166.

The actuating cam follower 166 receives a crank portion 168 of the actuating cam 162 attached to the lower end of the actuating rod 164. Rotation of the actuating rod 164 rotates the cam 162 which positively reciprocates the cam follower 166 and the plunger 136 so as to shift the clutches 96, 98 between the forward, neutral and reverse drive positions.

With reference to FIGS. 2 and 3, the inner and outer propulsion shafts 52, 74 extend from the transmission 80, through the bearing carrier 116 to the propulsion device 36 to drive the propulsion device 36 when selectively driven by the transmission 80. A ring nut 169, which is attached to the lower unit 28, secures the bearing carrier 116 to the lower unit 28.

The inner propulsion shaft 52, as noted above, extends through front gear hub 102 where the needle bearing assembly 104 journals the front end of the inner propulsion shaft 52 within the front gear 88. The inner propulsion shaft 52 also extends through the rear gear hub 114 and through the hollow outer propulsion shaft 74. As seen in FIG. 2, a needle bearing assembly 170 journals and supports the inner shaft 52 at the rear end of the outer propulsion shaft 74. The inner shaft 52 projects beyond the rear end of the outer shaft 74 to support the rear propeller 40.

As best seen in FIG. 3, the inner shaft 52 includes a front facing thrust shoulder 172 which acts against the rear engagement surface 108 of the front gear 88. The inner shaft 52 transfers forward driving thrusts to the front gear 88 through this contact. The front trust bearing assembly 92 takes this thrust loading in addition to the normal loading on the front driven bevel gear 88.

The inner shaft 52 also includes a rear facing thrust shoulder 174 which acts against the front engagement surface 110 of the rear gear 90. The inner shaft 52 transfers reverse driving thrusts to the rear gear 90 and the rear thrust bearing assembly 94 through this engagement. An anti-friction washer 176 desirably is positioned between the thrust shoulder 174 of the inner shaft 52 and the front surface 110 of the rear gear 90 to reduce friction between these components which rotate in opposite directions under at least one drive condition.

As seen in FIG. 3, the enlarged front rim 152 of the outer shaft lies directly behind the bearing hub 114 of the rear gear 90. The outer shaft 74 includes a thrust flange 178 which circumscribes the front opening of the front rim 152. The thrust flange acts against the cone 122 of the rear thrust bearing assembly 94 in an opposite direction to the axial force loading applied by the rear gear 90 and the inner shaft 52. This thrust loading arrangement thus reduces the thrust loading on the rear thrust bearing assembly 94 as the opposing loads cancel each other to some degree under the forward drive condition. The resultant thrust loadings are transferred through the bearing assembly 94 to either the bearing carrier 116 or the shim ring 128 and lower unit 28, depending upon the drive condition.

A front needle bearing assembly 180 journals a front rim 152 of the outer propulsion shaft 74 within the enlarged front end of the bearing carrier 116. The needle bearing assembly 180 is positioned within a recess 182 formed in the bearing carrier 116. An outer race 184 of the bearing assembly 180 holds the needle bearings in place.

The recess 182 desirably is located at an axial position (i.e., at a position along the axis of the inner shaft 52) which generally corresponds to the axial position of the rear clutch 98. In this manner, the outer shaft 74 is supported about the spline connection between the outer shaft 74 and the rear clutch 98 and at its front end. The stability of the shaft 74 is improved while moving the front needle bearing 180 forward to decrease the size of the bearing carrier 116. This arrangement provides more space within the lower unit 28 behind the transmission 80 for the exhaust passage 72, as discussed below.

To the rear of the front bearing assembly 180, the outer shaft 74 includes a rear facing thrust shoulder 186 formed at a transition in diameter between the large front rim 152 and the balance of the shaft 74. The rear thrust shoulder 186 acts against a bearing assembly formed by needle-like thrust bearings 188 positioned between a pair of anti-friction washers 190. This bearing arrangement minimizes friction between the bearing carrier 116 and the rotating outer shaft 74, while allowing the transfer of a rearward thrust loading from the shaft 74 to the bearing carrier 116.

With reference to FIG. 2, a rear needle bearing assembly 192 supports the outer propulsion shaft 74 at the rear end of the bearing carrier 116. The outer shaft 74 projects beyond the rear end of the bearing carrier 116 to support the front propeller 38.

FIG. 4 illustrates another preferred embodiment of the present transmission. Where appropriate, like numbers with an "a" suffix have been used to indicate like parts between the two embodiments for ease of understanding. The present transmission **80*a* is substantially identical to the transmission 80 described above, except for the configuration of the thrust flange 178*a* of the outer shaft 74*a* and the bearing assembly supporting the rear gear 90*a*. Accordingly, the foregoing discussion should be understood as applying equally to the present transmission 80*a***, unless specified to the contrary.

A double row, angular contact, ball bearing 200 supports the bearing hub **114*a* of the rear gear. The shoulder 124*a* of the rear gear 90*a* acts against an inner race 202 of the bearing 200. In this manner, the bearing 200 takes the loading on the rear gear 90*a***.

An outer race 204 of the bearing 200 is captured between the shim ring **128*a* positioned in front of the bearing carrier 116*a* and an anti-friction washer 206. As seen in FIG. 4, the outer race 204 of the bearing lies within the enlarged front end of the bearing carrier 116*a*, and is spaced from an inner wall 208 of the bearing carrier 116*a*** to provide a lubricant passage.

The thrust flange **178*a* located on the front of the outer shaft rim 152*a* defines both a front facing surface and a rear facing surface. The front facing surface of the thrust flange 178*a* acts against a needle-like thrust bearings 210. The bearings 210 are positioned between the thrust flange 178***a* and the anti-friction washer 206 that contacts the outer race 204 of the rear bearing assembly 200. Forward thrust loadings on the outer shaft 74 are transferred through the needle-like bearings 210, the anti-friction washer 206, the bearing outer race 204, to the shim ring 128*a* and the lower unit 28*a*.

The flange 178*a* contacts a second plurality of needle-like thrust bearings 212 on its rear facing surface. The needle bearings 212 act against an anti-friction washer 214. The washer 214 is seated within a groove in the inner wall 208 of the bearing carrier 116*a* in front of the recess 182*a* in which the front needle-bearing assembly 180*a* lies.

The bearing carrier 116*a* takes reverse thrust loadings on the outer shaft 74 through the bearings 212 and the washer 214. The bearing carrier 116*a* also takes the force loadings on the rear gear 90*a*. The normal loading on the rear bevel gear 90*a*, together with reverse thrust loadings on the inner shaft 52*a*, are transferred to the thrust flange 178*a* of the outer shaft 74*a* through the bearing assembly 200, the anti-friction washer 206 and the needle-like thrust bearings 210. The bearing carrier 116*a* takes these loadings from the outer shaft 74*a* in the manner described above.

Figure 5:
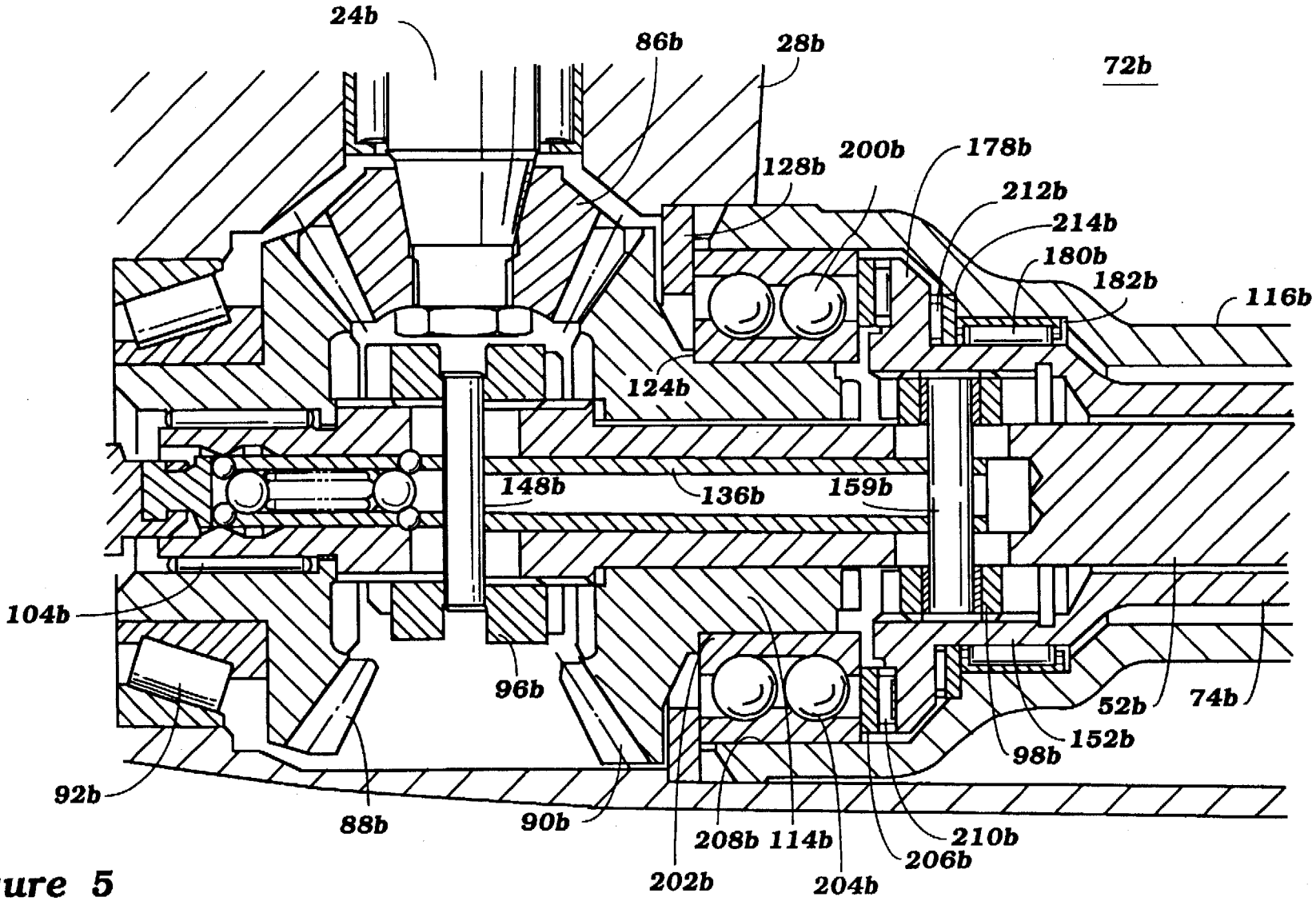
FIG. 5 is an enlarged, sectional side elevational view of a transmission in accordance with an additional embodiment of the present invention.

FIG. 5 illustrates another preferred embodiment of the present transmission. Where appropriate, like numbers with a "b" suffix have been used to indicate like parts between the embodiments of FIGS. 4 and 5 for ease of understanding. The present transmission 80*b* is substantially identical to the transmission 80*a*described above, except for the configuration of the bearing assembly supporting the rear gear. The outer race 204*b* of the double row, angular contact, ball bearing 200 sits against the inner wall 208*a* of the bearing carrier 116 at its enlarged front end, and is captured between the shim ring 128*b* and the anti-friction washer 206*b* in this position.

A small groove circumscribes the front of the bearing carrier 116 at its front end. The groove forms a lubricant passage S between the bearing carrier 116, the shim ring 128*b*, and the outer race 204*b* of the bearing 200*b*.

The anti-friction washer 206*b* acts against both the inner and outer races of the bearing 200*b* The thrust flange 178*b* of the outer shaft 74*b* thus acts on the inner race 202*a*of the bearing 200 in an opposite direction to the force loading applied by the rear gear 90*b* and the inner shaft 526. This thrust loading arrangement thus reduces the thrust loading on the bearing 200*b* as the opposing loads somewhat cancel each other under a forward drive condition.

Figure 6:
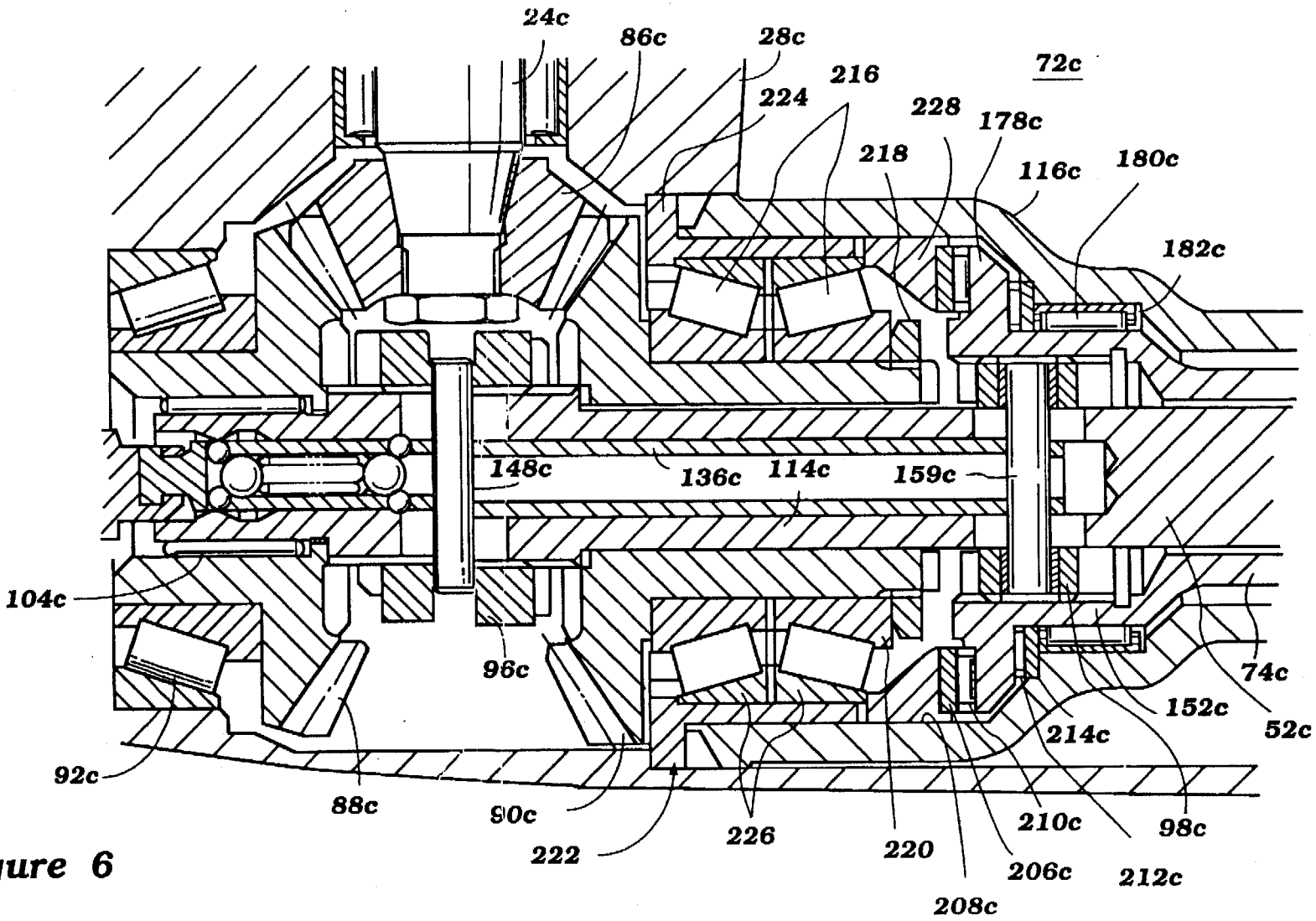
FIG. 6 is an enlarged, sectional side elevational view of a transmission in accordance with yet another embodiment of the present invention.

FIG. 6 illustrates another preferred embodiment of the present transmission. Where appropriate, like numbers with a "c" suffix have been used to indicate like parts between the embodiments of FIGS. 5 and 6 for ease of understanding. The present transmission 80*c* is substantially identical to the transmission 80*b* described above, except for the configuration of the bearing assembly supporting the rear gear 90*c*. Accordingly, the foregoing discussion should be understood as applying equally to the present transmission 80*c*, unless specified to the contrary.

Two juxtaposed taper roller bearings 216 support the bearing hub 114*c* of the rear gear 90*c*. The bearings 216 are arranged so as to take thrust loadings in opposite axial directions. In the illustrated embodiment, the bearings 216 are directly mounted; however, it is understood that the bearings could be arranged to be indirectly mounted (i.e., with the backs of each bearing facing each other).

The bearing hub 114*c* has an elongated length as compared with the bearing hubs of the above embodiments in order to support the bearings 216. The bearing hub 114*c* also carries an external thread about the periphery of its rear end.

A ring nut 218 is threaded onto the rear end of the bearing hub 114*c* to preload the bearings 216 in the axial direction. The ring nut 218 compresses the cones 220 of the bearings 216 against the shoulder 124*c* of the rear gear 90*c*. The loading between the gears 86*c*, 90*c* can be set to some degree by adjusting the preload using the ring nut 218.

A spacer ring 222 is used to position the bearings 216 within the enlarged front end of the bearing carrier 116*c*. The spacer ring 222 includes a front lip 224 which is captured between the front end of the bearing carrier 116*c* and a portion of the lower unit housing 28*c*. The spacer ring 222 also includes an annular recess which receives the cups 226 of the bearings 216.

An annular flange 228 is formed at the rear end of the spacer ring 222. The flange 228 rests against the anti-friction washer 206*c*. Forward thrust loadings on the outer shaft 74 are transferred through the needle-like bearings 210*c*, the anti-friction washer 206*c*, and spacer ring 222 to the lower unit 28*c*.

Rearward loadings on the rear gear 90*c*, due either to the normal loading on the bevel gear or to thrust loadings transferred from the inner shaft 52*c*, are transferred through the bearings 216 to the spacer ring 222. The loading in this direction is carried by both the spacer ring 222 and the thrust flange 178*c* of the outer shaft. That is, the spacer ring 222, which is secured to the lower unit housing 28*c* by its front lip 224, take some of the loading. A portion of the force loading from the rear gear 90*c* is also transferred to the thrust flange 178*c* through the thrust bearings 210*c*and the anti-friction washer 206*c* which contacts the flange 228 of the spacer ring 222. The bearing carrier 116*c* then takes this portion of the loading from the thrust flange 178*c* in the manner described above.

As common with all of the embodiments described above, the needle bearing assembly, which journals the front end of the outer shaft, is positioned within a recess formed in the bearing carrier. The recess is positioned at about the same axial position as the rear clutch. In this manner, the outer shaft is supported about the spline connection between the outer shaft and the rear clutch and at its front end. The front end of the outer shaft 74 consequently vibrates less than in prior transmission designs in which the outer shaft 74 is supported behind the corresponding clutch.

By moving the front needle bearing forward, the stability of the outer shaft is improved, while decreasing the size of the bearing carrier toward its rear end. This arrangement provides more space within the lower unit behind the transmission. The increased flow area behind the transmission at the transition of the exhaust discharge duct within the lower unit to the exhaust discharge passage formed through the propellers allows for a smoother discharge of exhaust gases from the engine. The increase flow area also increases the capacity of the exhaust system of the outboard motor to accommodate larger engines.

In addition, with the thrust flange of the outer shaft positioned in front of the needle bearing assembly, the thrust flange can cooperate with the thrust bearing assembly which supports the rear gear hub. Few bearing therefore are required in the present transmission arrangement than in prior transmissions, which translates into production and possibly maintenance cost savings.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A transmission for a marine outboard drive comprising a driven gear and a clutch coupled to a propulsion shaft, said driven gear being supported by a first bearing assembly, said propulsion shaft extending along a drive axis and including at least one thrust flange arranged to act against said first bearing assembly, a second bearing assembly positioned between said thrust flange and at least a portion of said first bearing assembly, and a third bearing assembly being positioned to one side of the second bearing assembly opposite of the first bearing assembly and being disposed along the drive axis in a position which is proximate to a position of the clutch along the drive axis, said third bearing assembly journalling a front end portion of the drive shaft.

2. A transmission as in claim 1, wherein the propulsion shaft extends through a bearing carrier along the drive shaft axis with the third bearing assembly journaling the from end portion of the propulsion shaft within the bearing carrier.

3. A transmission as in claim 1, wherein said second bearing assembly is arranged to act directly against the first bearing assembly to transfer a thrust loading in an axial direction.

4. A transmission as in claim 1, wherein said thrust flange of said shaft is arranged to load said first bearing assembly in an opposite axial direction from the loading applied by said driven gear.

5. A transmission as in claim 1, wherein said shaft includes a hollow rim in which said clutch is disposed.

6. A transmission as in claim 1, wherein said driven gear includes a bearing hub which is supported by said first bearing assembly, and said bearing hub includes a plurality of positive clutching elements positioned on an end which are configured to engage said clutch.

7. A transmission as in claim 6 additionally comprising a ring nut threaded onto the end of said bearing hub so as to load said first bearing assembly against an annular shoulder on said driven gear.

8. A transmission as in claim 2, wherein said first bearing assembly supports at least a portion of said driven gear within said bearing carrier.

9. A transmission as in claim 2, additionally comprising a fourth bearing assembly mounted between the thrust flange and the bearing carrier.

10. A transmission as in claim 9, wherein said fourth bearing assembly lies adjacent to the thrust flange on a side opposite from that on which the second bearing assembly lies.

11. A transmission as in claim 9, wherein the fourth bearing assembly is positioned along the drive shaft axis at a location between the thrust flange and the third bearing assembly.

12. A transmission for an marine outboard drive comprising a driven gear and a clutch coupled to a propulsion shaft, said driven gear being supported by a first bearing assembly, said first bearing assembly comprising a double row bearing, said propulsion shaft including at least one thrust flange arranged to act against said first bearing assembly, and a second bearing assembly positioned between said thrust flange and at least a portion of said first bearing assembly.

13. A transmission for a marine outboard drive comprising a first driven gear supported at least in part by a first bearing assembly within a portion of a housing, a corresponding first clutch which is coupled to a first propulsion shaft of said outboard drive to selectively couple said first propulsion shaft to said first driven gear, said propulsion shaft rotating about a rotational axis and having a thrust flange positioned along said drive axis behind said driven gear, and a second bearing assembly which is juxtaposed to and lies at a location along the drive axis directly forward of said thrust flange, said second bearing assembly being mounted to journal a front surface of the thrust flange within the housing and a third bearing assembly arranged along the drive shaft axis behind the second bearing assembly and proximate to the position of the first clutch along the drive shaft axis, said third bearing assembly supporting said propulsion shaft.

14. A transmission as in claim 12, wherein said first bearing assembly supports at least a portion of said first driven gear within said housing.

15. A transmission as in claim 12 wherein said first bearing assembly supports a bearing hub of said first driven gear, said bearing hub including a threaded end onto which a ring nut is threaded so as to load said first bearing assembly against an annular shoulder on said first driven gear.

16. A transmission as in claim 13 additionally comprising a second counter-rotating driven gear and a second clutch positioned between said first and second driven gears, said second clutch being coupled to a second propulsion shaft of said outboard drive to selectively couple said second propulsion shaft to one of said first and second driven gear to establish a first or a second drive condition, respectively, said second propulsion shaft arranged to act against said first driven gear to transfer thrust loadings from said second propulsion shaft to first driven under said first drive condition.

17. A transmission as in claim 16, wherein said first bearing assembly is arranged to transfer the thrust loadings on said first driven gear to said thrust flange of said first propulsion shaft.

18. A transmission as in claim 13, wherein the second bearing assembly is interposed between at least a portion of the first bearing assembly and the thrust flange of the first propulsion shaft.

19. A transmission as in claim 13 additionally comprising a fourth bearing assembly positioned behind the thrust flange of the first propulsion shaft and mounted between the thrust flange and a portion of the housing to journal a rear surface of the thrust flange within the housing.

* * * * *

UNITED STATES PATENT AND TRADEMARK OFFICE
CERTIFICATE OF CORRECTION

PATENT NO. : 5,716,247

DATED : February 10, 1998

INVENTOR(S) : Hiroshi Ogino

It is certified that error appears in the above-identified patent and that said Letters Patent is hereby corrected as shown below:

In Claim 2, column 11, line 20, "the from end" should be --the front end--.

In Claim 16, column 12, line 40, "driven under" should be --driven gear under--.

Signed and Sealed this

Twenty-third Day of June, 1998

*Attest:*

Bruce Lehman

BRUCE LEHMAN

*Attesting Officer*

*Commissioner of Patents and Trademarks*